US006438915B1

(12) United States Patent
Beauboeuf

(10) Patent No.: US 6,438,915 B1
(45) Date of Patent: Aug. 27, 2002

(54) PRE-FABRICATED WALL PANEL

(76) Inventor: Seymour L. M. Beauboeuf, 20681 NE. 4th Pl., Apt 103, North Miami Beach, FL (US) 33179

( * ) Notice: Subject to any disclaimer, the term of this patent is extended or adjusted under 35 U.S.C. 154(b) by 13 days.

(21) Appl. No.: 09/684,507

(22) Filed: Oct. 6, 2000

(51) Int. Cl.[7] ..... E04B 1/04

(52) U.S. Cl. ..... 52/271; 52/270; 52/284; 52/286; 52/309.4

(58) Field of Search ..... 52/284, 270, 271, 52/286, 309.4

(56) References Cited

U.S. PATENT DOCUMENTS

| | | | | | |
|---|---|---|---|---|---|
| 1,168,583 | A | * | 1/1916 | Volz | 52/284 |
| 1,356,590 | A | * | 10/1920 | Baumann | 52/284 |
| 1,430,431 | A | * | 9/1922 | Binkley | 52/284 |
| 3,286,423 | A | * | 11/1966 | Donion | 52/288 |
| 3,775,916 | A | | 12/1973 | Bair | |
| 3,962,842 | A | * | 6/1976 | Wilhelm | 52/286 |
| 4,234,634 | A | | 11/1980 | Longinotti | |
| D264,001 | S | | 4/1982 | Ankarswed | |
| 4,409,768 | A | | 10/1983 | Boden | |
| 4,633,630 | A | * | 1/1987 | Kindylides | 52/286 |
| 4,949,518 | A | | 8/1990 | Nagel et al. | |
| 5,765,330 | A | | 6/1998 | Richard | |

* cited by examiner

*Primary Examiner*—Carl D. Friedman
*Assistant Examiner*—Christy M. Green

(57) ABSTRACT

A pre-fabricated wall panel for providing a new type of wall structure. The pre-fabricated wall panel includes a panel member having a thickness and a cavity disposed therein and extending a length thereof with the panel member further having a first side, a second side, a first side end, a second side end, and a first end portion which extends outwardly from the first side end and which is generally recessed relative to the first side and with the panel member being adapted to fasten to a beam and to a floor of a building structure.

14 Claims, 7 Drawing Sheets

PRE-FABRICATED WALL PANEL

BACKGROUND OF THE INVENTION

1. Field of the Invention

The present invention relates to a partition panel and more particularly pertains to a new pre-fabricated wall panel for providing a new type of wall structure.

2. Description of the Prior Art

The use of a partition panel is known in the prior art. More specifically, a partition panel heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,234,634; U.S. Pat. No. 5,765,330; U.S. Pat. No. 3,775,916; U.S. Pat. No. 4,409,768; U.S. Pat. No. 4,949,518; and U.S. Pat. No. Des. 264,001.

While these devices fulfill their respective, particular objectives and requirements, the aforementioned patents do not disclose a new pre-fabricated wall panel. The inventive device includes a panel member having a thickness and a cavity disposed therein and extending a length thereof with the panel member further having a first side, a second side, a first side end, a second side end, and a first end portion which extends outwardly from the first side end and which is generally recessed relative to the first side and with the panel member being adapted to fasten to a beam and to a floor of a building structure.

In these respects, the pre-fabricated wall panel according to the present invention substantially departs from the conventional concepts and designs of the prior art, and in so doing provides an apparatus primarily developed for the purpose of providing a new type of wall structure.

SUMMARY OF THE INVENTION

In view of the foregoing disadvantages inherent in the known types of partition panel now present in the prior art, the present invention provides a new pre-fabricated wall panel construction wherein the same can be utilized for providing a new type of wall structure.

The general purpose of the present invention, which will be described subsequently in greater detail, is to provide a new pre-fabricated wall panel which has many of the advantages of the partition panel mentioned heretofore and many novel features that result in a new pre-fabricated wall panel which is not anticipated, rendered obvious, suggested, or even implied by any of the prior art partition panel, either alone or in any combination thereof.

To attain this, the present invention generally comprises a panel member having a thickness and a cavity disposed therein and extending a length thereof with the panel member further having a first side, a second side, a first side end, a second side end, and a first end portion which extends outwardly from the first side end and which is generally recessed relative to the first side and with the panel member being adapted to fasten to a beam and to a floor of a building structure.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pre-fabricated wall panel which has many of the advantages of the partition panel mentioned heretofore and many novel features that result in a new pre-fabricated wall panel which is not anticipated, rendered obvious, suggested, or even implied by any of the prior art partition panel, either alone or in any combination thereof.

It is another object of the present invention to provide a new pre-fabricated wall panel which may be easily and efficiently manufactured and marketed.

It is a further object of the present invention to provide a new pre-fabricated wall panel which is of a durable and reliable construction.

An even further object of the present invention is to provide a new pre-fabricated wall panel which is susceptible of a low cost of manufacture with regard to both materials and labor, and which accordingly is then susceptible of low prices of sale to the consuming public, thereby making such pre-fabricated wall panel economically available to the buying public.

Still yet another object of the present invention is to provide a new pre-fabricated wall panel which provides in the apparatuses and methods of the prior art some of the advantages thereof, while simultaneously overcoming some of the disadvantages normally associated therewith.

Still another object of the present invention is to provide a new pre-fabricated wall panel for providing a new type of wall structure.

Yet another object of the present invention is to provide a new pre-fabricated wall panel which includes a panel member having a thickness and a cavity disposed therein and extending a length thereof with the panel member further having a first side, a second side, a first side end, a second side end, and a first end portion which extends outwardly from the first side end and which is generally recessed relative to the first side and with the panel member being adapted to fasten to a beam and to a floor of a building structure.

Still yet another object of the present invention is to provide a new pre-fabricated wall panel that is strong, lightweight, and highly versatile.

Even still another object of the present invention is to provide a new pre-fabricated wall panel that has excellent acoustic insulation properties.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
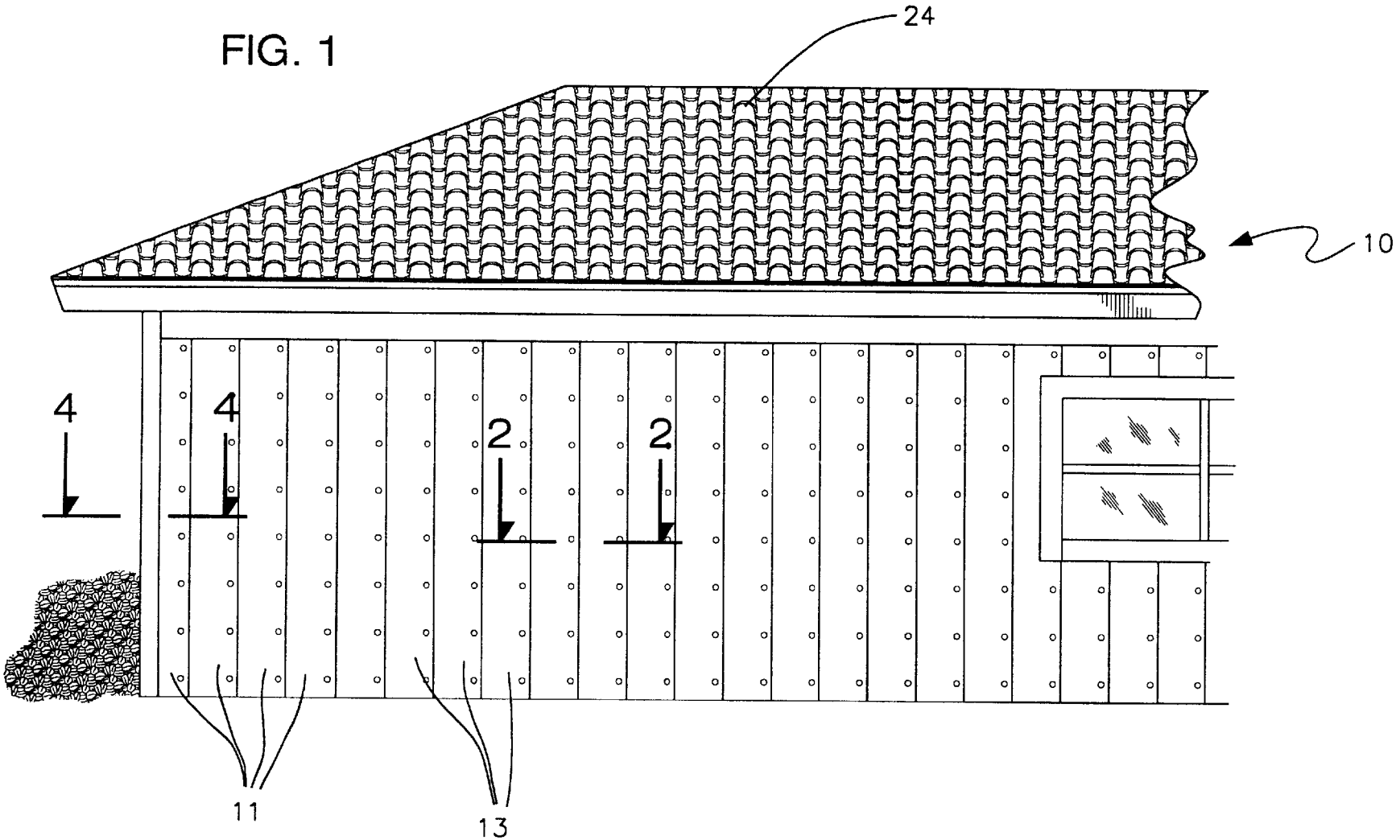
FIG. 1 is a side elevational view of a new pre-fabricated wall panel according to the present invention shown in use.
Figure 2:
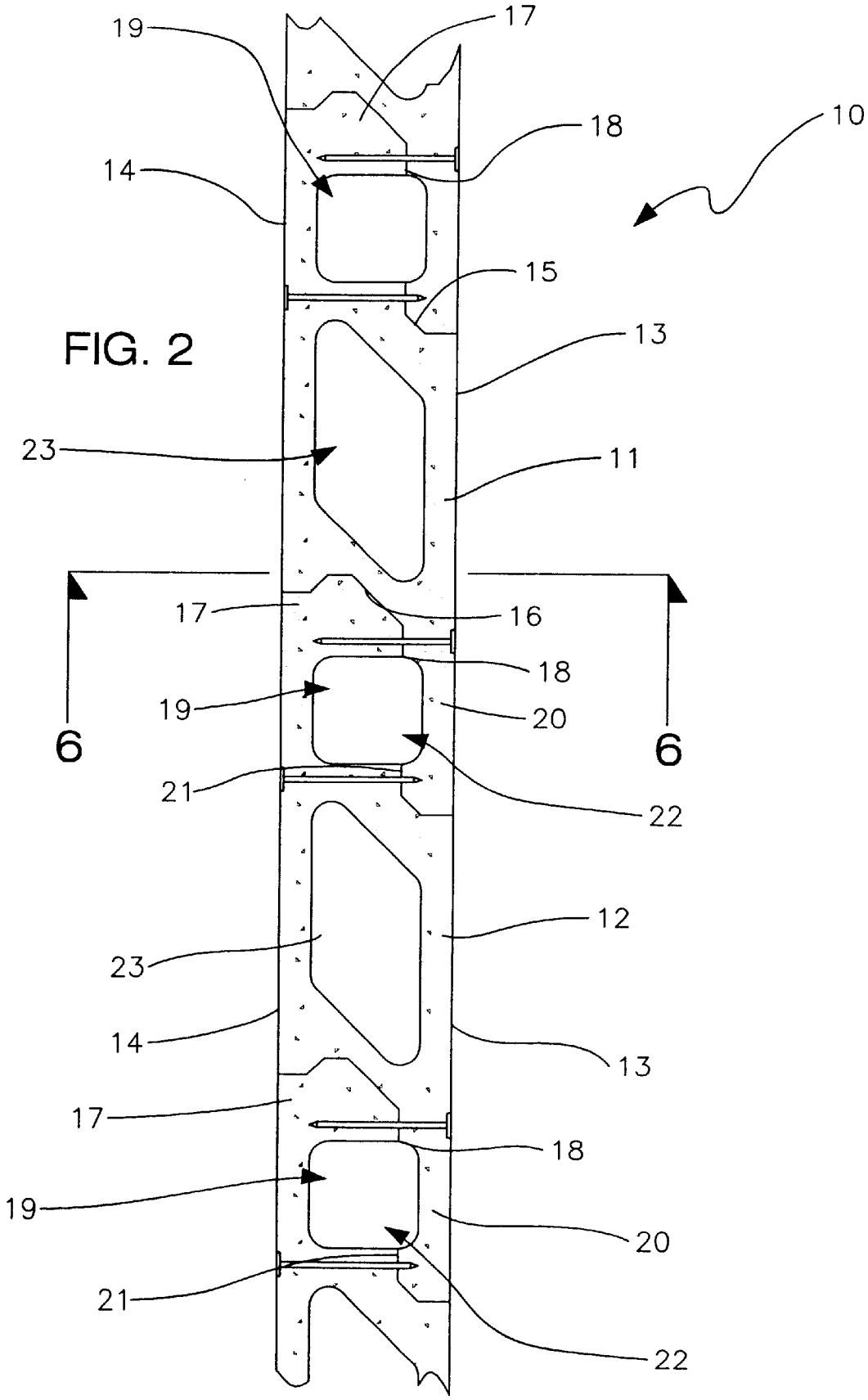
FIG. 2 is a top plan view of the present invention.
Figure 3:
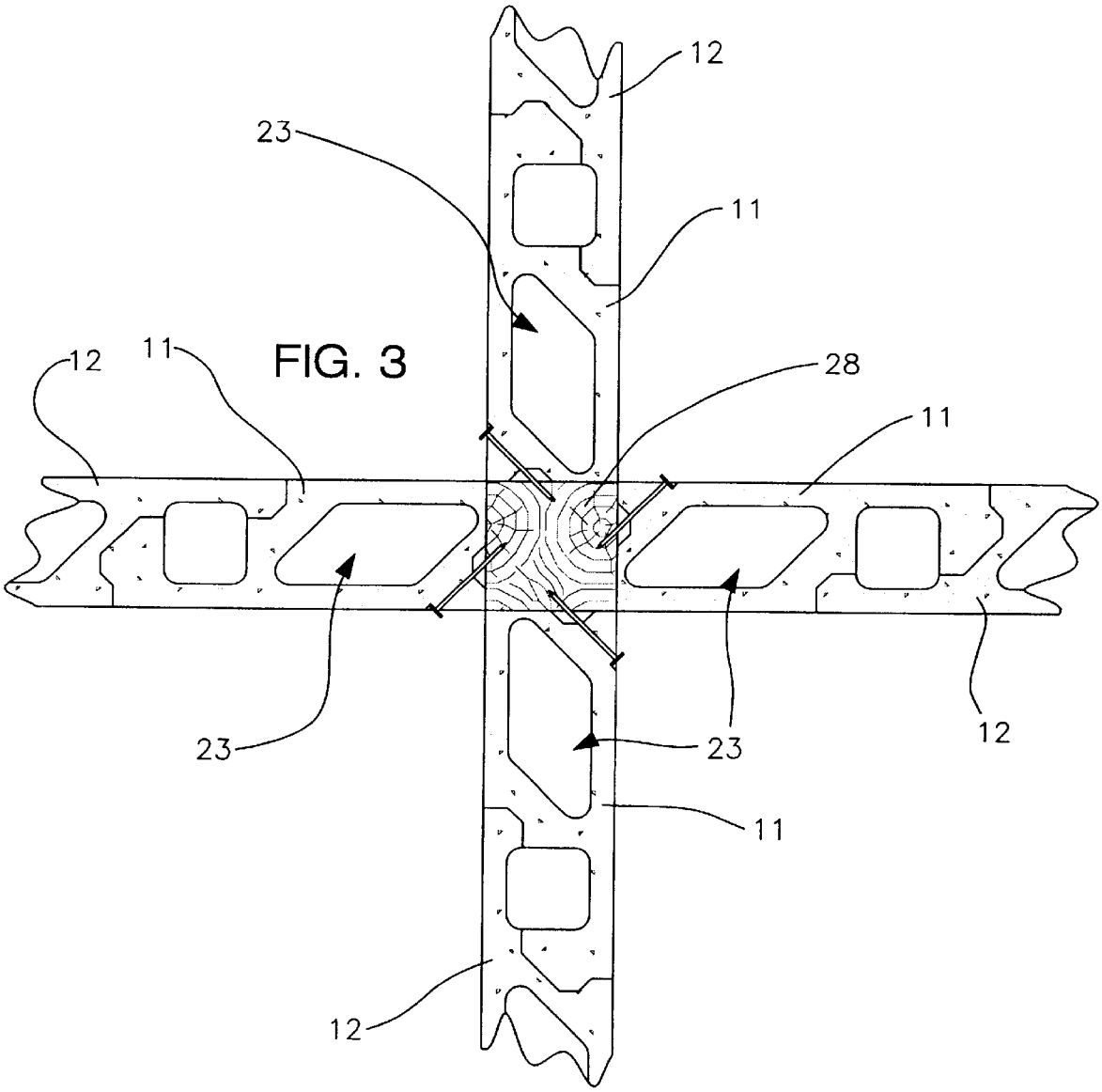
FIG. 3 is a top plan view of the present invention shown in use.
Figure 4:
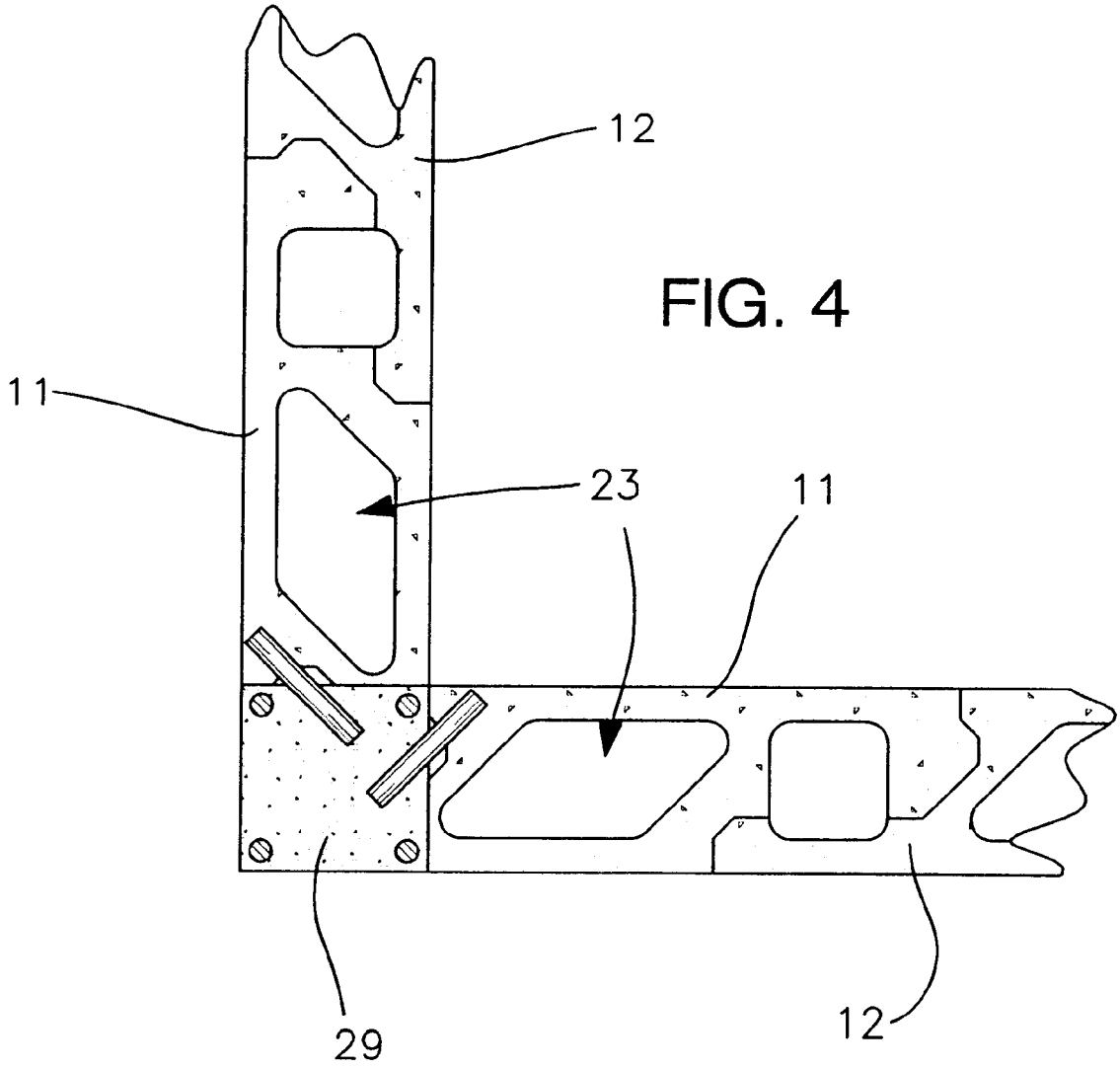
FIG. 4 is another top plan view of the present invention shown in use with a corner column.
Figure 5:
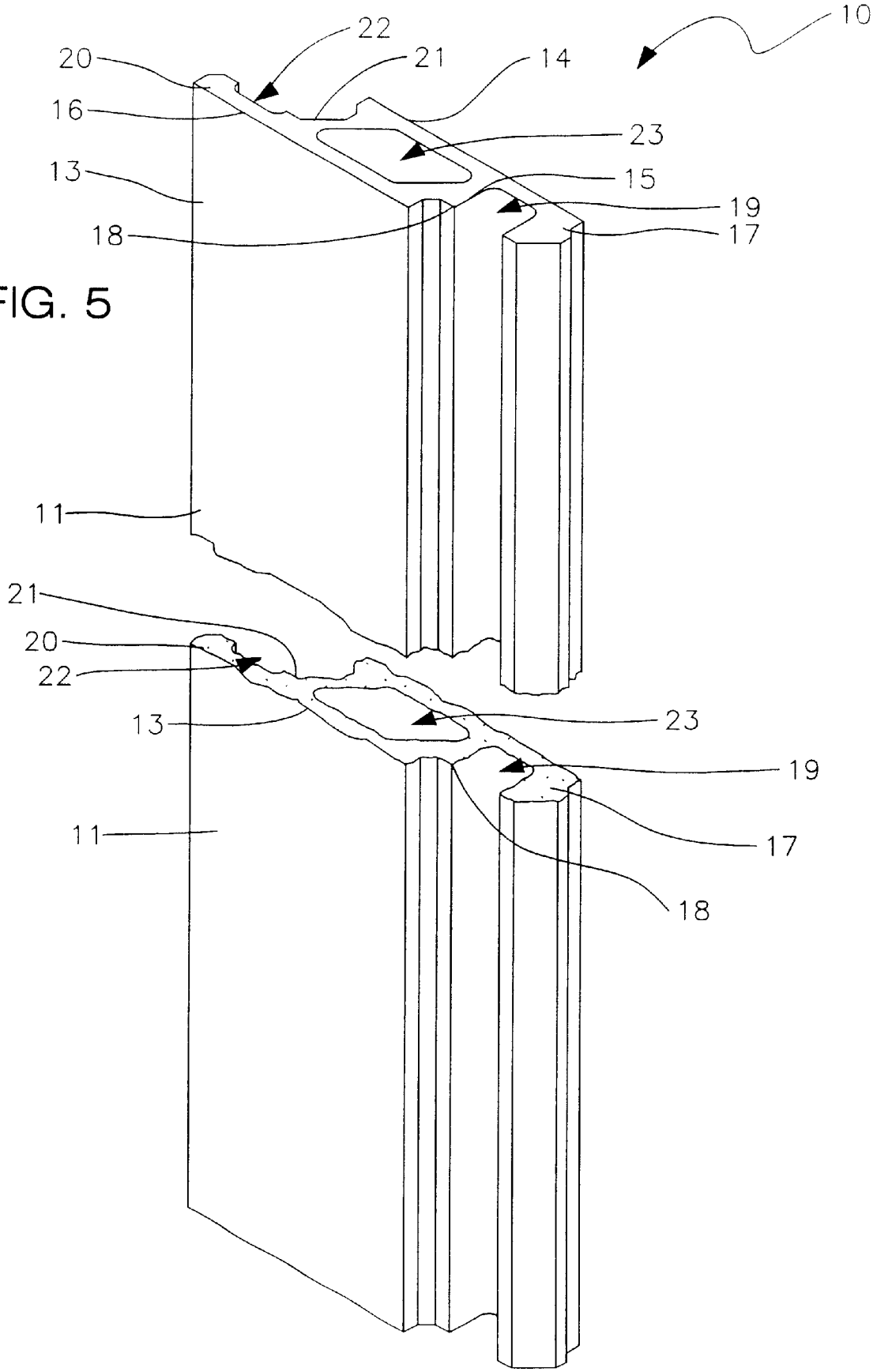
FIG. 5 is a perspective view of the present invention.
Figure 6:
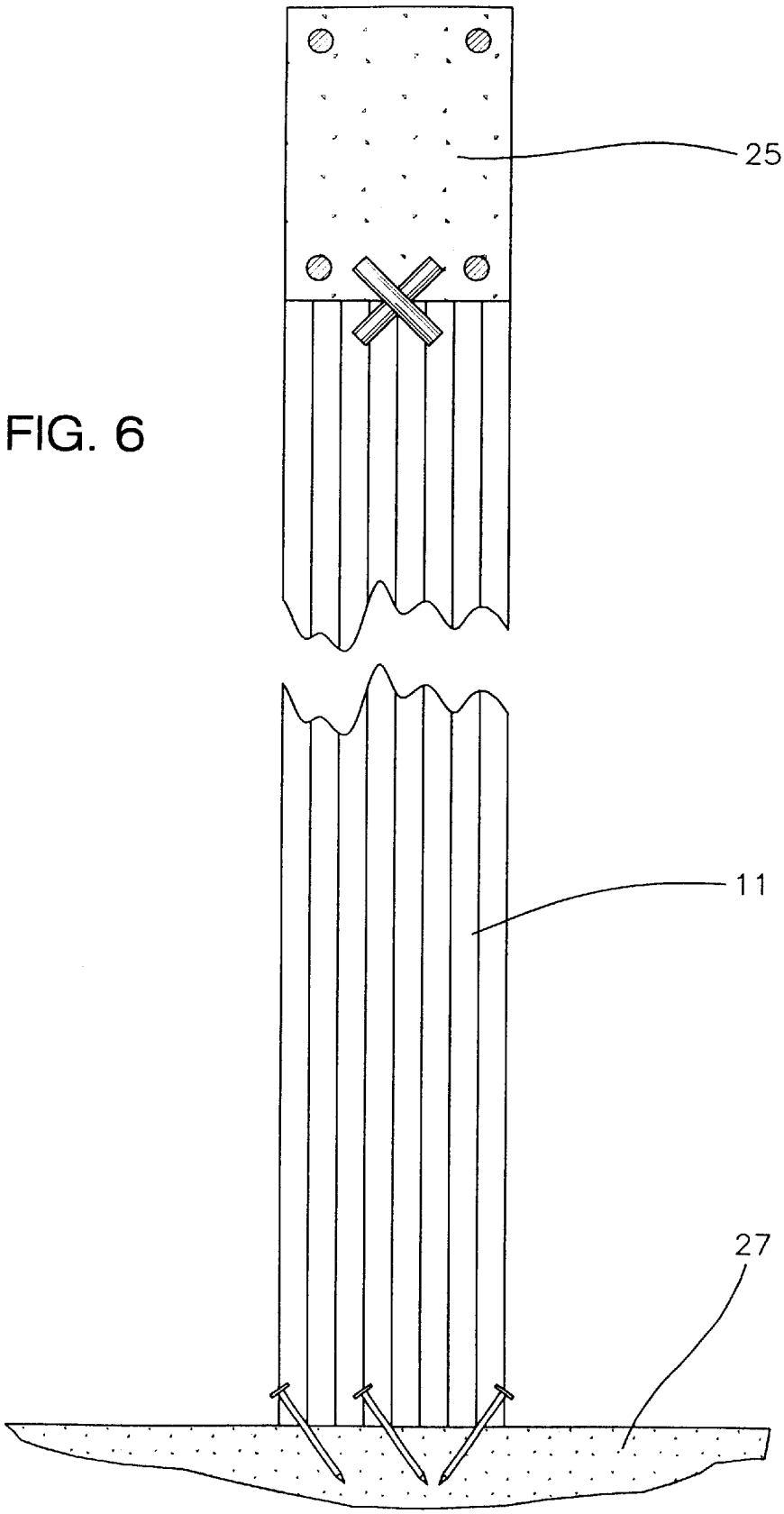
FIG. 6 is a side end elevational view of the present invention shown in use with a concrete beam.
Figure 7:
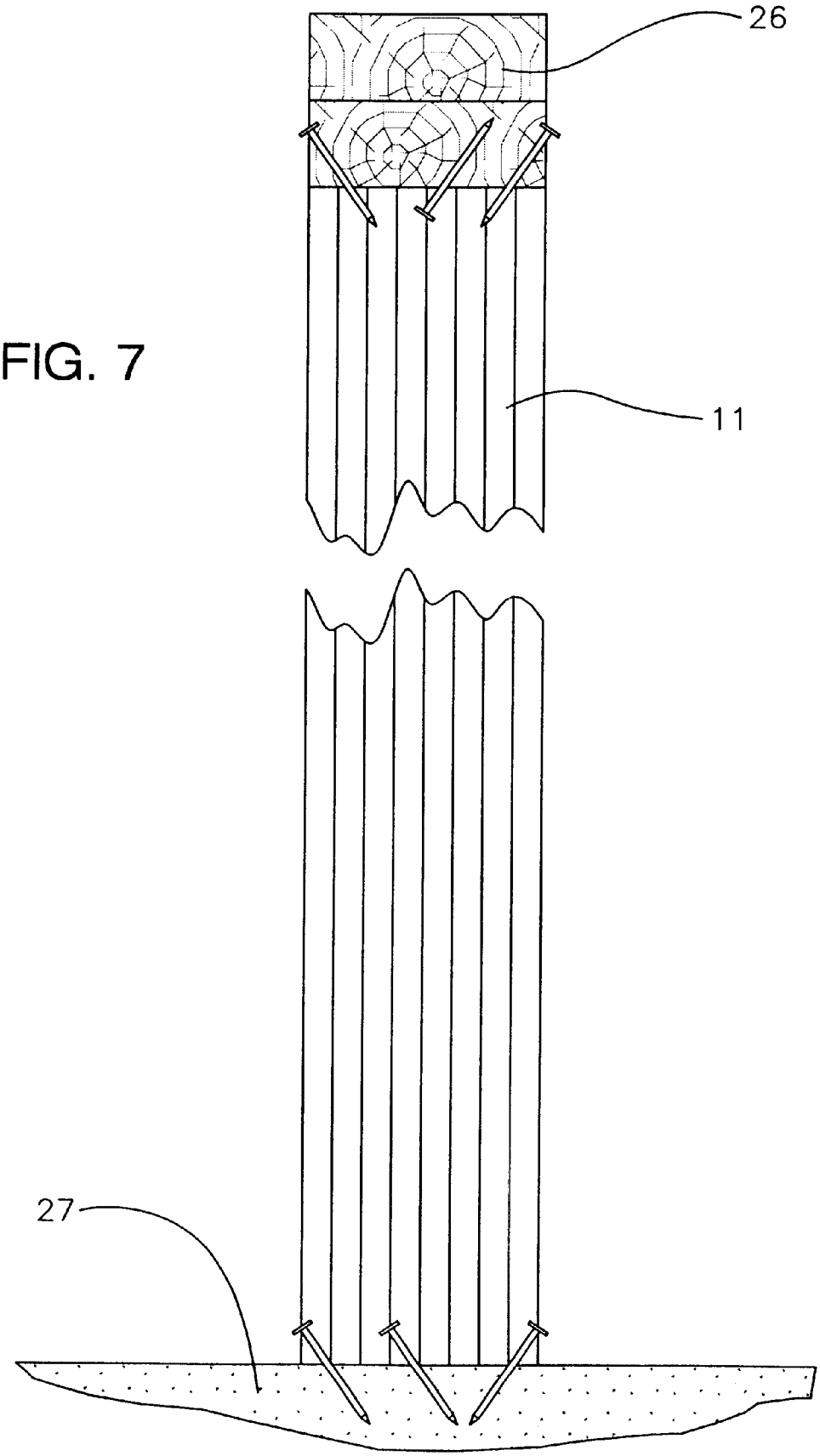
FIG. 7 is a side end elevational view of the present invention shown in use with a wood beam.

With reference now to the drawings, and in particular to FIGS. 1 through 7 thereof, a new pre-fabricated wall panel embodying the principles and concepts of the present invention and generally designated by the reference numeral 10 will be described.

As best illustrated in FIGS. 1 through 7, the pre-fabricated wall panel 10 generally comprises a panel member 11 having a thickness and a cavity 23 disposed therein and extending a length thereof. The panel member 11 further has a first side 13, a second side 14, a first side end 15, a second side end 16, and a first end portion 17 which integrally extends outwardly from the first side end 15 and which is generally recessed relative to the first side 13. The panel member 11 is adapted to fasten to a wood beam 26 or concrete beam 25 and to a floor 27 of a building structure 24. The panel member 11 further includes a second end portion 20 which integrally extends outwardly from the second side end 16 and which is generally recessed relative to the second side 14 of the panel member 11. The first end portion 17 has a first side 18 and a groove 19 extending in the first side thereof and extending a length of the panel member 11. The second end portion 20 has a second side 21 and a groove 22 extending in the second side 21 thereof and extending the length of the panel member 11. The cavity 23 has a rhomboidal cross-sectional shape. The first end portion 17 has a side end which is essentially multi-sided and the second portion 20 has a side end which is also multi-sided. The panel member 11 including a plurality of the wall panels 11,12 being connected side end to side end with the first end portion 17 of one of the wall panels 11 being connected to and overlapping the second end portion 20 of another of the wall panels 12 with the groove 19 of the first end portion 17 being in alignment with the groove 22 of the second end portion 20 thus forming a generally square-shaped cavity. The panel member 11 includes essentially water, perlite, cement, and sisal fibers with the sisal fibers having a length of approximately 1 to 2 inches. The panel member 11 has a length of approximately 8 feet and a width of approximately 2 feet and a thickness of approximately 6 inches.

In use, the user, using nails and screws, fastens the panel members 11,12 side end to side end with the first end portion 17 of one of the panel members 11 overlapping the second end portion 20 of another of the panel members 12 to essentially form a wall structure of a building structure 24. The panel members 11,12 are further fastened to beams made of wood 26 or concrete 25 and to a floor 27 and also to corner columns made of wood 28 and concrete 29.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pre-fabricated wall panel comprising:

a panel member having a thickness and a cavity disposed therein and extending a length thereof said panel member further having a first side, a second side, a first side end, a second side end, a first end portion which extends outwardly from said first side end and which is generally recessed relative to said first side, a second end portion which extends outwardly from said second side end and which is generally recessed relative to said second side of said panel member;

wherein said first end portion has a first side and a groove extending in said first side thereof and extending a length of said panel member and said second end portion has a second side and a groove extending in said second side thereof and extending the length of said panel member; and wherein said panel member includes a plurality of said panel members being connected side end to side end, said first end portion of one of said panel members being connected to said second end portion of another of said panel members with said groove of said first end portion being in alignment with said groove of said second end portion thus forming a generally square-shaped cavity.

2. A pre-fabricated wall panel as described in claim 1, wherein said cavity has a rhomboidal cross-sectional shape.

3. A pre-fabricated wall panel as described in claim 1, wherein said first end portion has a side end which is multi-sided and said second end portion has a side end which is multi-sided.

4. A pre-fabricated wall panel as described in claim 1, wherein said panel member includes essentially water, perlite, cement, and sisal fibers.

5. A pre-fabricated wall panel as described in claim 4, wherein said sisal fibers have a length of approximately 1 to 2 inches.

6. A pre-fabricated wall panel comprising:

a panel member having a thickness and a cavity disposed therein and extending a length thereof, said panel member further having a first side, a second side, a first side end, a second side end, and a first end portion which extends outwardly from said first side end and which is generally recessed relative to said first side, said panel member being adapted to fasten to a beam and to a floor of a building structure, said panel member further including a second end portion which extends outwardly from said second side end and which is generally recessed relative to said second side of said panel member, said first end portion having a first side and a groove extending in said first side thereof and extending the length of said panel member, said second end portion having a second side and a groove extending in said second side thereof and extending a length of said panel member, said cavity having a rhomboidal cross-sectional shape, said first end portion having a side end which is essentially multi-sided and said second portion having a side end which is also multi-sided, said panel member including a plurality of said panel members being connected side end to side end, said first end portion of one of said panel members being connected to said second end portion of another of said panel members with said groove of said first end portion being in alignment with said groove of said second end portion thus forming a generally square-shaped cavity, said panel member including essentially water, perlite, cement, and sisal fibers, said sisal fibers having a length of approximately 1 to 2 inches, said panel member having a length of approximately 8 feet and a width of approximately 2 feet and a thickness of approximately 6 inches.

7. A pre-fabricated wall panel comprising:

a panel member having a length, said panel member having a first side, a second side, a first side end, a second side end, a first end portion which extends outwardly from said first side end, a second end portion which extends outwardly from said second side end;

wherein said first end portion defines a first groove and said second end portion defines a second groove, said first and second grooves being configured such that when said first end portion of a first said panel member is abutted against said second end portion of a second said panel member, said first and second grooves form a substantially rectangular-shaped cavity between said first end portion of the first said panel member and said second end portion of the second said panel member.

8. A pre-fabricated wall panel as described in claim 7, wherein said panel member has a thickness with a cavity disposed therein, said cavity extending said length of said panel member.

9. A pre-fabricated wall panel as described in claim 7, wherein said first end portion is generally recessed relative to said first side of said panel member and said second end portion is generally recessed relative to said second side of said panel member.

10. A pre-fabricated wall panel as described in claim 7, wherein said first groove extends into a first side of said first end portion and said second groove extends into a second side of said second end portion.

11. A pre-fabricated wall panel as described in claim 8, wherein said cavity has a rhomboidal cross-sectional shape.

12. A pre-fabricated wall panel as described in claim 7, wherein said first end portion has a side end which is multi-sided and said second end portion has a side end which is multi-sided.

13. A pre-fabricated wall panel as described in claim 7, wherein said panel member comprises water, perlite, cement, and sisal fibers.

14. A pre-fabricated wall panel as described in claim 13, wherein said sisal fibers have a length of approximately 1 to 2 inches.

* * * * *